US006513918B1

(12) United States Patent
Faisst et al.

(10) Patent No.: US 6,513,918 B1
(45) Date of Patent: Feb. 4, 2003

(54) SCREEN MESH CATCHER FOR A CONTINUOUS INK JET PRINTER AND METHOD FOR MAKING SAME

(75) Inventors: Charles F. Faisst, Avon, NY (US); Timothy J. Wojcik, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/656,627

(22) Filed: Sep. 7, 2000

(51) Int. Cl.[7] ..... B41J 2/02; B41J 2/185
(52) U.S. Cl. ..... 347/73; 347/90
(58) Field of Search ..... 347/90, 36, 34, 347/73

(56) References Cited

U.S. PATENT DOCUMENTS

| | | | | |
|---|---|---|---|---|
| 3,836,914 A | | 9/1974 | Duffield | |
| 3,878,519 A | | 4/1975 | Eaton | 347/75 |
| 4,107,699 A | | 8/1978 | Kenworthy | 347/47 |
| 4,135,196 A | * | 1/1979 | Siozaki | 347/76 |
| 4,442,440 A | | 4/1984 | Elchinger | 347/74 |
| 4,460,903 A | | 7/1984 | Guenther et al. | 347/90 |
| 4,591,869 A | | 5/1986 | Katerberg et al. | 347/21 |
| 4,757,328 A | | 7/1988 | Braun et al. | 347/90 |
| 5,105,205 A | | 4/1992 | Fagerquist | 347/90 |
| 5,469,202 A | | 11/1995 | Stephens | 347/90 |
| 5,583,551 A | | 12/1996 | Allred et al. | |

FOREIGN PATENT DOCUMENTS

EP 0 521 345 B1 6/1996

* cited by examiner

*Primary Examiner*—Thinh Nguyen
(74) *Attorney, Agent, or Firm*—William R. Zimmerli

(57) ABSTRACT

A screen mesh ink drop catcher assembly, which is adapted to catch non-printed ink drops while not catching printed ink drops, includes a housing having a fluid return channel, and a screen extending from the housing operable to collect unwanted ink drops. The housing of the ink drop catcher assembly may include at least one surface, at least a portion of which is grooved and operatively associated with the screen thereby improving ink drop flow from the screen to the fluid return channel. The housing of the ink drop catcher assembly may include a screen support with the screen being at least partially positioned about the screen support. The screen support of the ink drop catcher assembly may include at least one surface, at least a portion of which is grooved and operatively associated with the screen thereby improving ink drop flow from the screen to the fluid return channel.

36 Claims, 8 Drawing Sheets

SCREEN MESH CATCHER FOR A CONTINUOUS INK JET PRINTER AND METHOD FOR MAKING SAME

FIELD OF THE INVENTION

This invention relates generally to the field of digitally controlled printing devices, and in particular to continuous ink jet printers in which a liquid ink stream breaks into droplets, some of which are selectively collected by a catcher and prevented from reaching a receiver while other droplets are permitted to reach a recording surface.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfers and fixing. Ink jet printing mechanisms can be categorized as either continuous ink jet or drop on demand ink jet.

Conventional continuous ink jet utilizes electrostatic charging tunnels that are placed close to the point where the drops are formed in a stream. In this manner individual drops may be charged. The charged drops may be deflected downstream by the presence of deflector plates that have a large potential difference between them. A catcher (sometimes referred to as a "gutter", an "interceptor", or a "collector") may be used to intercept either the charged or the uncharged drops, while the non-intercepted drops are free to strike a receiver or recording medium. U.S. Pat. No. 3,878,519, which issued to Eaton on Apr. 15, 1975, discloses a method and apparatus for synchronizing droplet formation in a liquid stream using electrostatic deflection by a charging tunnel and deflection plates. The function of a deflection charge plate and its associated catcher in a continuous jet printer is well known, being described in U.S. Pat. No. 4,107,699 which issued to Kenworthy on Aug. 15, 1977. The catcher may be an integral part of systems which serve multiple functions, including: blocking unwanted ink droplets, collecting and removing unwanted ink droplets, measuring drop charge levels, recycling ink, and solving start-up and shut-down problems.

Individual ink droplets receive an electrical charge. An opposite electrical charge is applied to the surface of a catcher parallel to the normal trajectory of the ink stream. The opposite polarities create an attraction force that deflects the droplets toward and onto the surface of the catcher. The droplets accumulate on the surface of the catcher until they are overcome by gravitational forces that cause the accumulated droplets to travel toward a collection area. U.S. Pat. No. 5,105,205, issued to Fagerquist on Apr. 14, 1992, and U.S. Pat. No. 5,469,202, issued to Stephens on Nov. 21, 1995, both disclose ink jet catcher assemblies of this type. However, the disadvantage of this type of catcher is that when ink strikes the surface of the catcher the force of the drop impact causes the ink to splatter and/or mist. Ink splatter and mist creates unwanted artifacts on the printed media that reduces image quality and the splatter and mist contaminate other components in the printer.

U.S. Pat. No. 4,757,328, which issued to Braun et al. on Jul. 12, 1988, illustrates an assembly of a catcher that minimizes splattering and misting. However, this type of catcher affects print quality in other ways. The need to create an electric charge on the catcher surface complicates the construction of the catchers and it requires more components. This complicated catcher structure requires large spatial volumes between the printhead and the media, increasing the ink drop trajectory distance. Increasing the distance of the drop trajectory decreases drop placement accuracy and affects the print image quality. There is a need to minimize the distance the drop must travel before striking the print media in order to insure high quality images.

U.S. Pat. No. 4,460,903, which issued to Guenther et al. on Jul. 17, 1994, also illustrates a catcher assembly that minimizes splattering and misting. However, as the ink drops first strike and collect on a hard surface of the catcher, the potential for splattering and misting still exists. Additionally, ink drops have built up on the surface of the catcher could be "flung" onto the receiving media by the movement of the printhead.

Continuous ink jet printheads, such as those shown in the Fagerquist patent and the Stephens patent, may incorporate a screen into the catcher to assist with ink fluid removal. Additionally, the Stephens patent includes a thick mesh insert that prevents the fine mesh screen from collapsing during assembly of the catcher. However, the thick mesh insert does not improve fluid removal. Additionally, these printheads experience the misting and splattering disadvantage discussed above.

Scanning type ink jet printheads, such as those shown in the Stephens patent, the Fagerquist patent, and the Braun et al. patent, experience acceleration forces that "fling" onto the media ink that has built up on the catcher. In order to minimize the amount of ink flung onto the media, a vacuum is commonly applied at one end of an ink removal channel to assist in removing the ink build up. However, air turbulence created by the vacuum decreases drop placement accuracy and adversely affects the print quality image.

Additionally, ink that has built up on catcher surfaces can become contaminated with paper dust, dirt, debris, etc., due to the operating environment of the catcher. Contaminated ink must be cleaned before the ink can be reused, adding to the overall cost and expense of an ink jet system. As the catcher is positioned in close proximity to the media, portions of the catcher are exposed to paper dust, dirt, debris, etc., that is easily collected on portions of the catcher, especially portions having ink buildup, causing the catcher to become clogged. When this happens, the catcher must be thoroughly cleaned prior to operating the ink jet system.

It can be seen that there is a need to provide a simply constructed catcher that reduces ink splattering and misting, increases fluid removal without affecting ink drop trajectory, and minimizes clogging of the catcher due to exposure to environmental debris such as paper dust.

SUMMARY OF THE INVENTION

It is an object of the present invention to provide a catcher that minimizes the distance that a drop must travel before striking the print media in order to insure high quality images.

It is another object of the present invention to provide a catcher of simple construction.

It is still another object of the present invention to provide a catcher that reduces ink splattering and misting.

It is still another object of the present invention to provide a catcher that reduces ink contamination, printhead maintenance, and printhead cleaning.

It is still another object of the present invention to provide a catcher that increases fluid removal without affecting ink drop trajectory.

It is still another object of the present invention to minimize clogging of the catcher due to exposure to environmental debris such as paper dust.

According to a feature of the present invention, an ink drop catcher assembly includes a housing defining a fluid return channel. At least a portion of the surface of the channel has a groove substantially parallel to the fluid return channel. A screen at least partially extends from the housing to collect non-printed ink drops. The screen is in fluid communication with the groove, thereby improving ink drop flow between the screen and the fluid return channel.

According to another aspect of the present invention, the housing of the ink drop catcher may include a screen support with the screen being at least partially positioned about the screen support.

According to another aspect of the present invention, the screen support includes a surface. At least a portion of the surface has a groove substantially parallel to the fluid return channel, the groove being in fluid communication with the screen thereby improving ink drop flow between the screen and the fluid return channel.

According to another aspect of the present invention, a printer includes a printhead having a printed ink drop path and a non-printed ink drop path. The printhead is operable to deliver ink drops along the printed ink drop path and the non-printed ink drop path. A catcher assembly is positioned adjacent the non-printed ink drop path. The catcher includes a screen extending into the non-printed ink drop path so that ink drops travelling along the non-printed ink drop path directly strike the screen.

According to another aspect of the present invention, the catcher assembly includes a housing defining a fluid return channel. At least a portion of the surface of the channel has a groove substantially parallel to the fluid return channel. The screen is in fluid communication with the groove, thereby improving ink drop flow between the screen and the fluid return channel.

According to another aspect of the present invention, the housing includes a screen support with the screen being at least partially positioned about the screen support such that the screen is positioned within a close tolerance to the printed ink drop path.

According to another aspect of the present invention, the screen support includes a surface. At least a portion of the surface has a groove substantially parallel to the fluid return channel, the groove being in fluid communication with the screen thereby improving ink drop flow between the screen and the fluid return channel.

According to another aspect of the present invention, a method of manufacturing an ink drop catcher assembly includes providing a housing defining a fluid return channel. Grooving at least a portion of the surface of the channel with the grooved portion being substantially parallel to the fluid return channel. Providing a screen at least partially extending from the housing operable to collect non-printed ink drops. Positioning the screen in fluid communication with the groove thereby improving ink drop flow between the screen and the fluid return channel.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
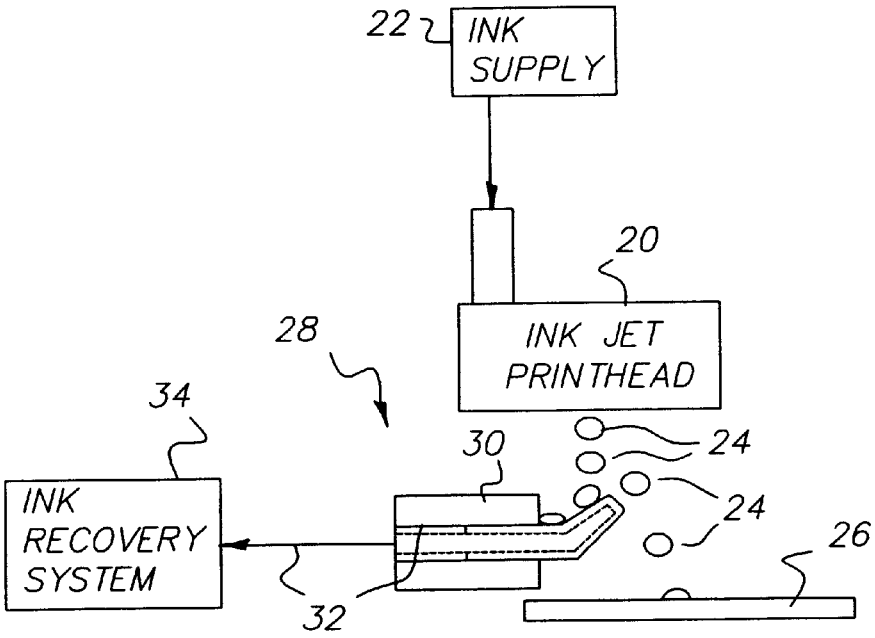
FIG. 1 is a schematic diagram of an inkjet printing apparatus.

Referring to FIG. 1, a printhead 20 receives ink from an ink supply reservoir 22 under pressure. As a pressurized ink stream exits from a nozzle opening of printhead 20, the stream breaks into droplets 24. Droplets 24 are selectively subjected to a force that can be turned on and off to determine whether each individual droplet strikes a recording media 26 such as a moving paper or falls into a catcher assembly 28. Typically attached to printhead 20, catcher assembly 28 includes a housing 30 defining at least one fluid return channel 32 for returning non-printed droplets to ink supply reservoir 22 via an ink recovery system 34. Typically, ink recovery system 34 includes a vacuum-generating mechanism that is used to apply a vacuum to fluid return channel 32 to assist with and improve ink fluid flow away from catcher assembly 28 and to ink recovery system 34. As illustrated, non-deflected droplets fall into catcher assembly 28 and deflected droplets reach recording media 26. However, printheads are known wherein the opposite is true, and the present invention can be used in conjunction with either type of printhead.

Figure 2:
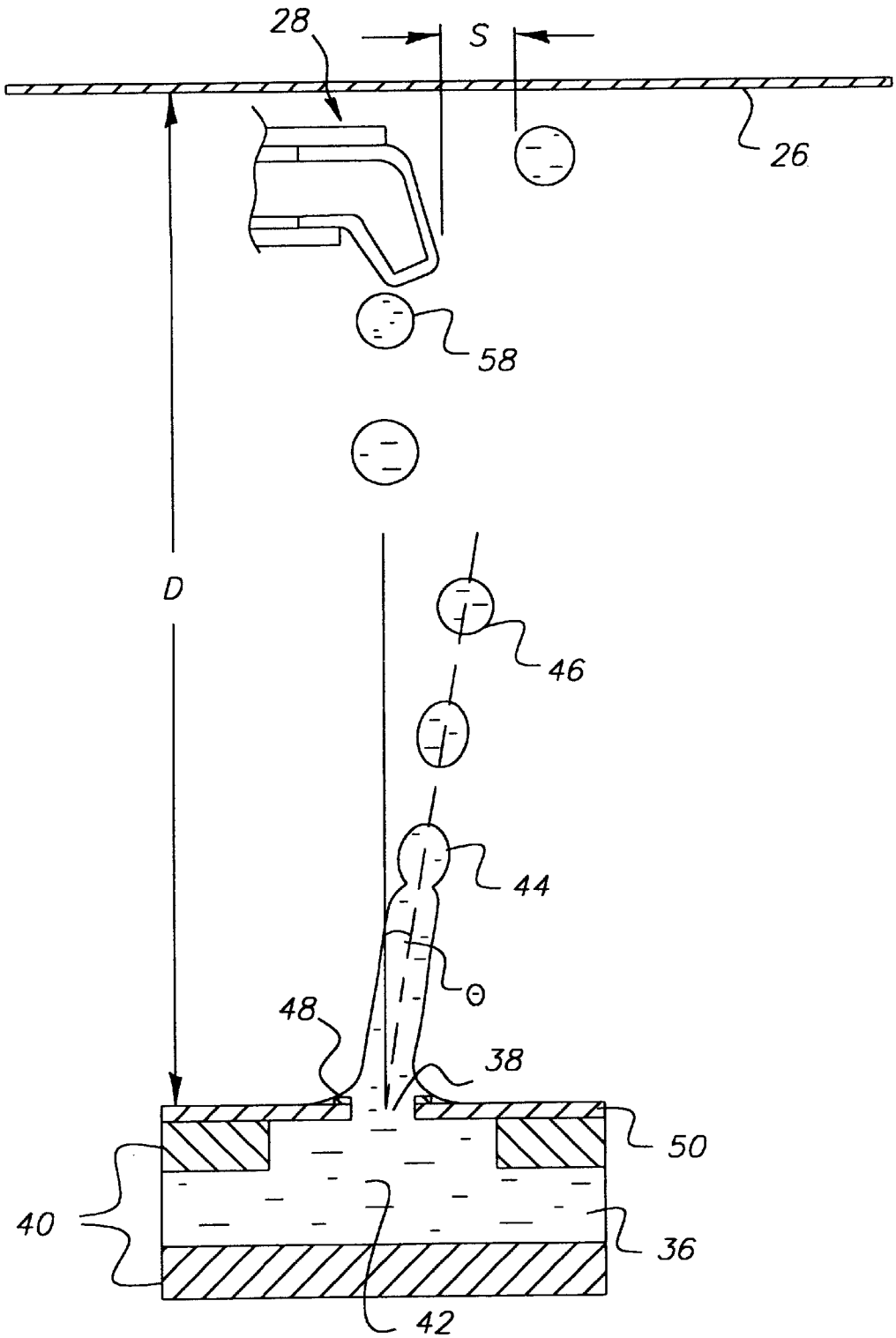
FIG. 2 is a partial cross sectional view of a nozzle bore with asymmetric heating deflection.

Referring to FIG. 2, a cross-sectional view of one nozzle of an array of such nozzles formed on printhead 20 of FIG. 1, an ink delivery channel 36, along with a plurality of nozzle bores 38 are etched in a substrate 40, which is silicon in this example. Delivery channel 36 and nozzle bores 38 may be formed by anisotropic wet etching of silicon, using a $p^+$etch stop layer to form nozzle bores 38. Ink 42 in delivery channel 36 is pressurized above atmospheric pressure, and forms a stream 44. At a distance away from nozzle bore 38, stream 44 breaks into a plurality of drops 46 due to a periodic heat pulse supplied by a heater 48. Heater 48 is separated from substrate 40 by thermal and insulating layers 50 to minimize heat loss to substrate. Nozzle bore 38 may be etched allowing the nozzle exit orifice to be defined by insulating layers 50.

Figure 3:
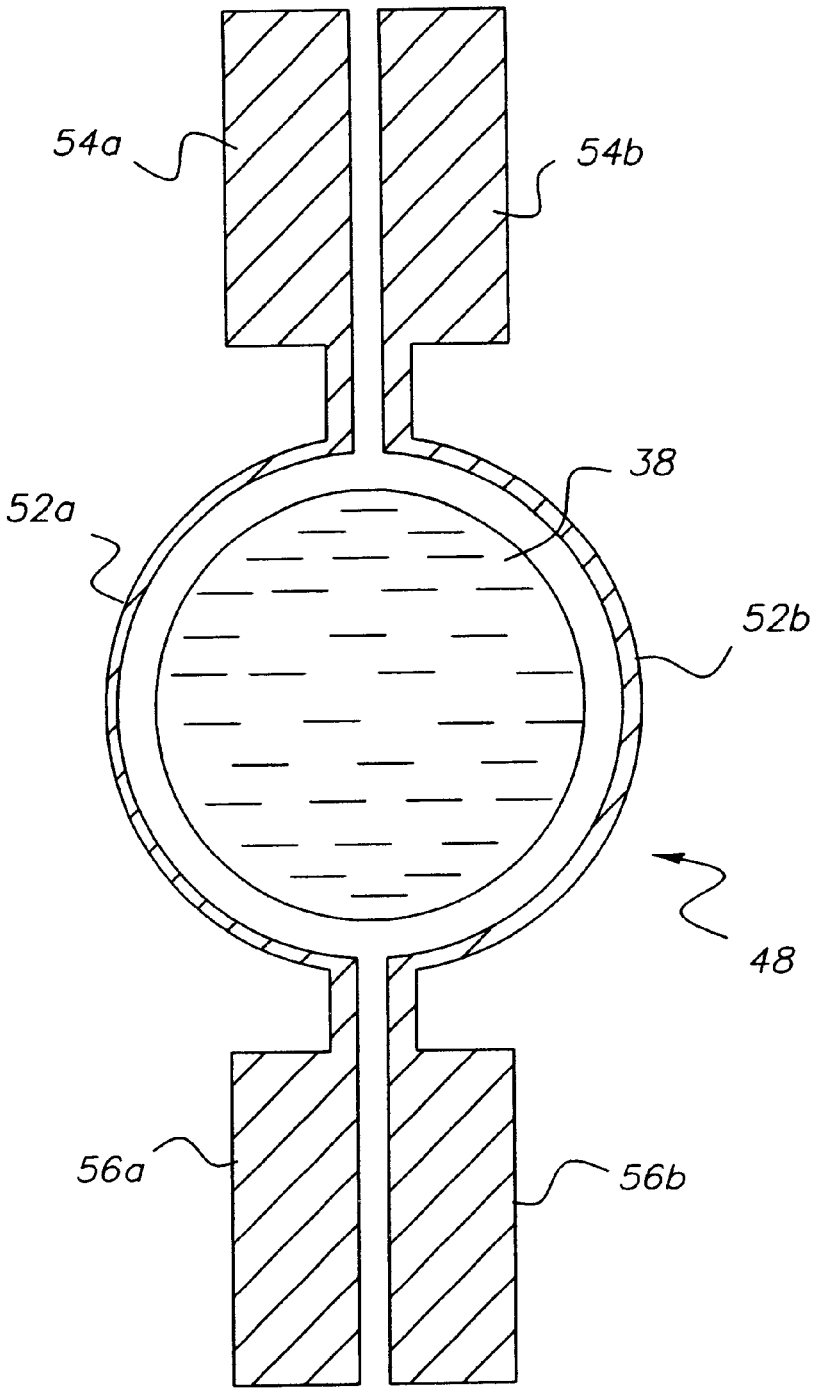
FIG. 3 is a top view of a circular nozzle bore with asymmetric heating deflection, shown with a heater having two opposing sections.

Referring to FIG. 3, heater 48 has two sections 52*a* and 52*b*, each covering approximately one-half of the perimeter of nozzle bore 38. The power connections 54*a* and 54*b* and the ground connections 56*a* and 56*b* from the drive circuitry of the heater (not shown) to heater 48 are also shown. Stream 44 may be deflected by an asymmetric application of heat by supplying electrical current to one, but not both, of heater sections 52*a* and 52*b*. This technology is distinct from other prior systems of electrostatic continuous-stream deflection printers, which rely upon deflection of charged drops previously separated from their respective streams. With stream 44 being undeflected, drops 46, shown in FIG. 2, may be blocked from reaching recording media 26 by catcher assembly 28 according to the present invention. In an alternate printing scheme, ink catcher assembly 28 may be placed to block deflected drops 46 so that undeflected drops 58 will be allowed to reach recording media 26.

Figure 4:
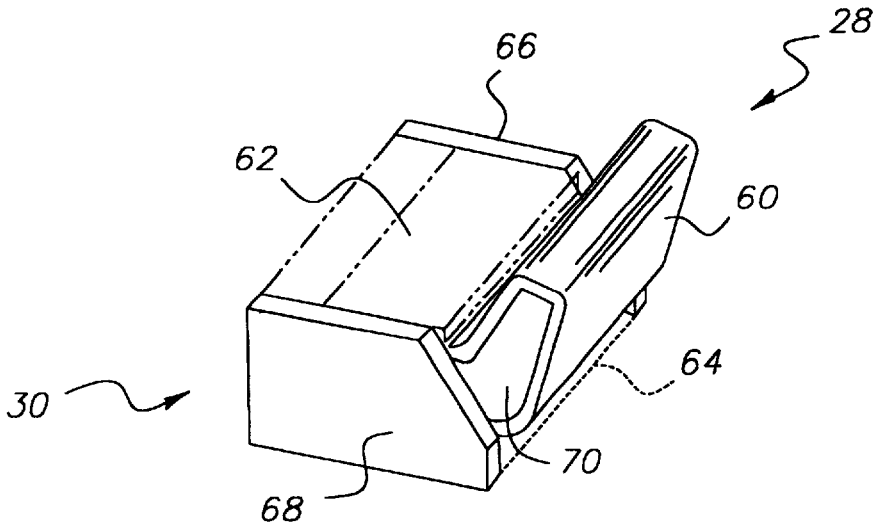
FIG. 4 is a perspective view of an inkjet catcher made in accordance with the presenting invention.
Figure 5:
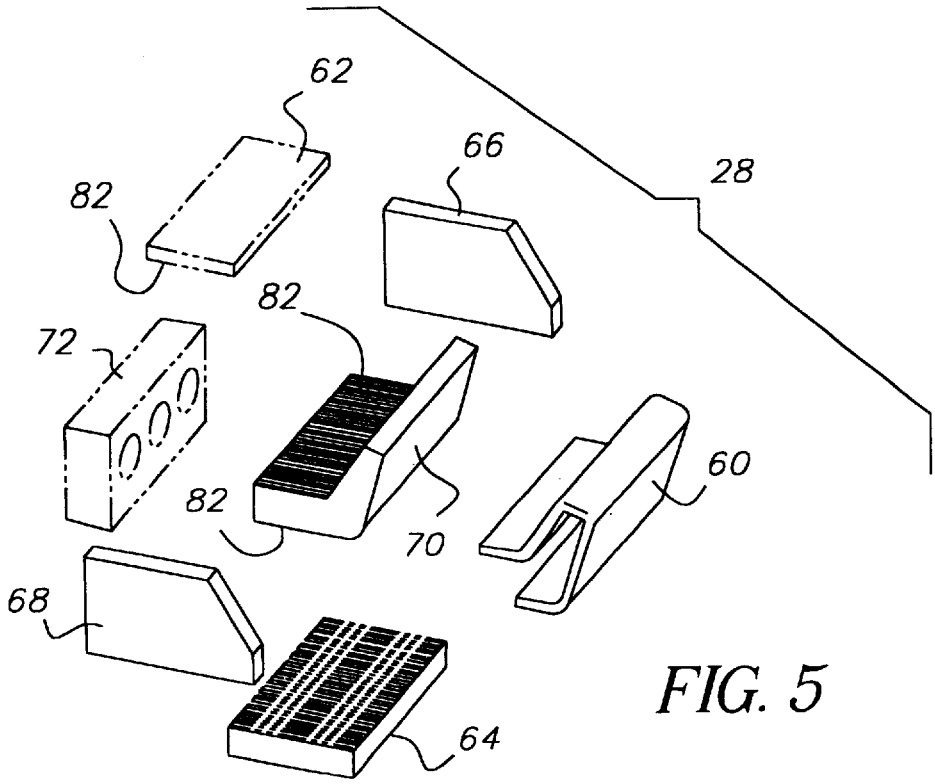
FIG. 5 is an exploded view of the catcher shown in FIG. 4.

Referring to FIGS. 4 and 5, catcher assembly 28 includes housing 30 and a screen 60 with screen 60 extending beyond housing 30. Housing 30 includes a top cover 62, a bottom cover 64, a right side cover 66, and a left side cover 68 positioned substantially about a screen support 70. Screen support 70 may also extend beyond housing 30. Housing 30 also includes a vacuum manifold 72 to which vacuum is applied to by a vacuum generating mechanism of ink recovery system 34 in order to improve and assist flow of non-printed ink droplets from catcher assembly 28 to ink recovery system 34.

Figure 6:
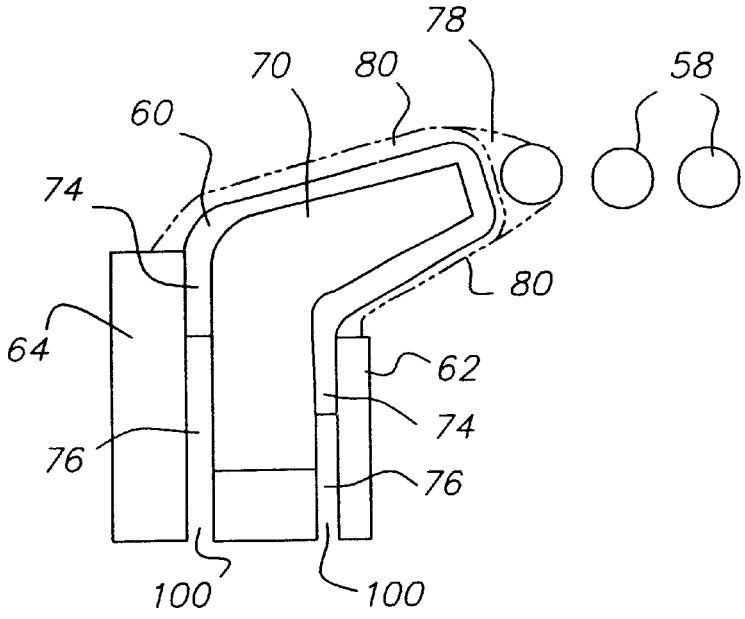
FIG. 6 is a partial side view of the catcher as shown in FIG. 4 with a side cover removed.

Referring to FIG. 6, in a preferred embodiment of the present invention, screen 60 may be positioned at least partially about screen support 70 with screen ends 74 being inserted into a pair of fluid return channels 76 defined by housing 30. In this embodiment, two fluid return channels 76 are created when screen support 70 is positioned substantially within housing 30, approximately centered between top cover 62 and bottom cover 64. However, it is contemplated and, therefore, within the scope of this disclosure that screen support 70 may be positioned substantially within housing 30 such that only one fluid return channel is created.

As non-printed ink droplets 58 contact screen 60, ink droplets 58 are transformed in shape, shown generally at 78, from a generally spherical shape to substantially a path or layer of fluid 80. Surface tension between fluid 80 and screen 60 cause fluid 80 to wet screen 60. The wetting of screen 60 creates a fluid layer or path 80, for the collected, non-printed ink droplets 58, away from screen 36 and towards fluid return channels 76.

In a preferred embodiment, a woven metal wire mesh material is used to manufacture screen 60. Woven in a manner very similar to that of textiles, the wire diameter of the screen 60 in a preferred embodiment of the present invention is approximately 1.0 to 1.5 mils, and woven in what is commonly called a twilled-dutch weave pattern yielding a spacing of approximately 8 microns. This type of wire mesh is commercially available from, for example, Ron-Vik, Inc., Minneapolis, Minn. Woven wire mesh having these characteristics has excellent shape retaining qualities, while the geometry and size of the weave spacing has superior fluid retention properties. However, a plastic, polymer, or cloth material could be woven and used for screen 60 with substantially similar results. Additionally, a paper filter media, a synthetic material, either woven or unwoven, or a sintered metal could also be used as the material for screen 60 with substantially similar results. Alternatively, an open cell foam could be used with substantially similar results, provided that a foam having a pore size sufficiently small enough to create a fluid layer was used.

The combination of the shape of the wire, the small apertures formed by the weaving process, and the ink droplets themselves creates the thin fluid layer 80 on the surface of screen mesh 60. The fluid layer 80 intercepts and absorbs the non-printed ink droplets preventing them from reaching the media. Additionally, as surface tension exists between the fluid layer 80 and screen mesh 60, collected ink droplets are prevented from being "flung" onto the recording media as the printhead moves and accelerates, thereby eliminating unwanted artifacts on the recording media and improving overall print quality. The screen mesh also acts as a filter, prohibiting environmental contaminants from entering he ink stream, thereby increasing ink recycling efficiency.

The catcher assembly of the present invention is operable to intercept and absorb non-printed droplets directly through the fluid layer 80 preventing the non-printed ink droplets from reaching recording media 26. As such, there is no need to deflect the non-printed ink droplets onto a surface of the catcher assembly prior to collecting the ink drops, thereby reducing or eliminating misting and splattering. This reduces printhead maintenance and cleaning.

Additionally, the catcher assembly of the present invention does not require a large geometry to accommodate an electrostatic electrode deflector to steer the ink droplets, or a large flat surface to collect the ink droplets after the ink droplets are deflected; therefore, the overall size of the catcher assembly is reduced. Although the ink drops must still be deflected by a heater, for example, in order to reach the printing media or be intercepted by the catcher assembly, the configuration of the catcher assembly allows the catcher assembly to be positioned closer to the ink jet printhead reducing ink drop trajectory distance. Reducing ink drop trajectory distance reduces printed drop placement error, thereby increasing print image quality.

Figure 7:
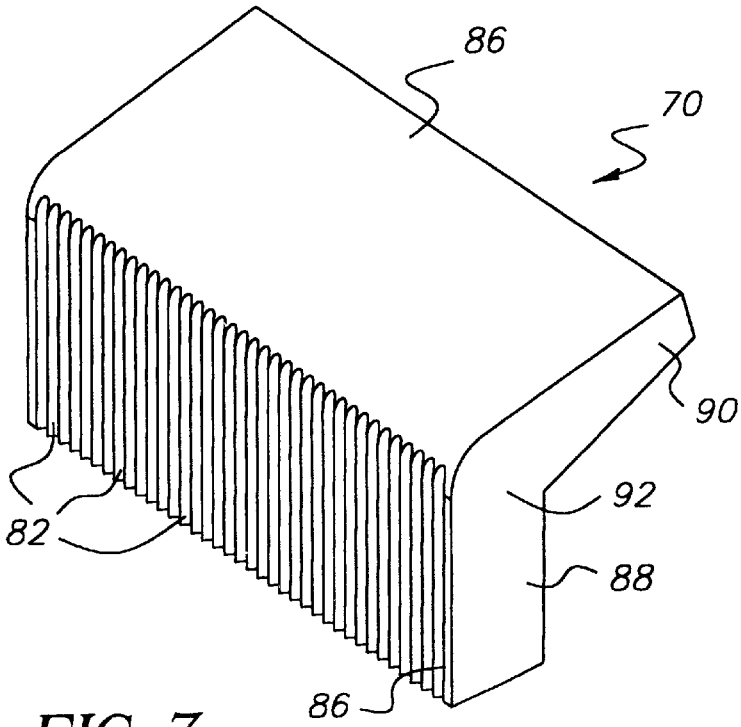
FIGS. 7 and 8 are perspective views of a portion of the catcher made in accordance with the present invention.
Figure 8:
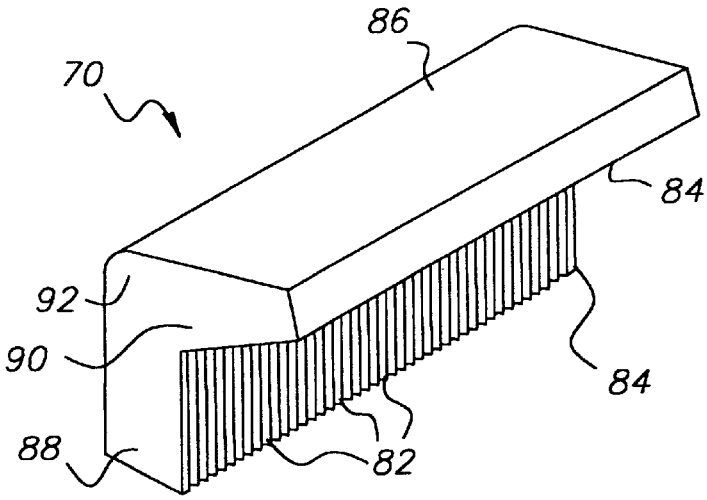

Again referring to FIG. 5, and to FIGS. 7 and 8, portions of screen support 70, bottom cover 64, and top cover 62 can be contoured or grooved such that at least one channel 82 is formed on one or more of these surfaces. FIGS. 7 and 8 show channels 82 in more detail using the screen support 70 as an example. However, it is to be understood, and therefore within the scope of this disclosure, that channels 82, as shown in FIGS. 7 and 8 may also be placed on surfaces of the bottom cover 64 and the top cover 62. Channels 82 are positioned longitudinally along front and back surfaces 84 and 86, respectively, of screen support 70. Typically, channels 82 are cut, milled, etched, molded, or integrally formed in surfaces 84 and 86 at the desired location of the placement. Channels 82 improve ink fluid flow from screen 60 to fluid return channels 76. As ink fluid flow is increased, the amount of vacuum typically required to remove ink fluid is significantly decreased. As such, the overall ink fluid removal capability of the catcher assembly is increased without the adverse effects on ink drop trajectory typically associated with applying vacuum to the fluid return channels.

Again referring to FIG. 6, as the operating environment of the printhead 20 is relatively confined and the angle of ink drop deflection is relatively small, tolerance issues are present. In this respect, screen support 70, acts to form and retain screen 60 in a precise shape. This allows precise placement of the screen in close proximity to the printed ink drop path such that the screen is operable to intercept non-printed ink drops directly. Positioning screen 60 substantially about screen support 70 in this manner also helps to eliminate ink fluid buildup on the backside of catcher assembly 28 because the ink may be removed through fluid return channel 76 positioned in a lower portion of the housing 30.

In a preferred embodiment, bottom cover 64, top cover 62, right side cover 66, left side cover 68, and screen support 70 are made from a plastic or other suitable polymer material. Alternatively, the components of housing 30 could be made from other materials such as stainless steel or ceramic, for example, with substantially similar results.

Figure 9:
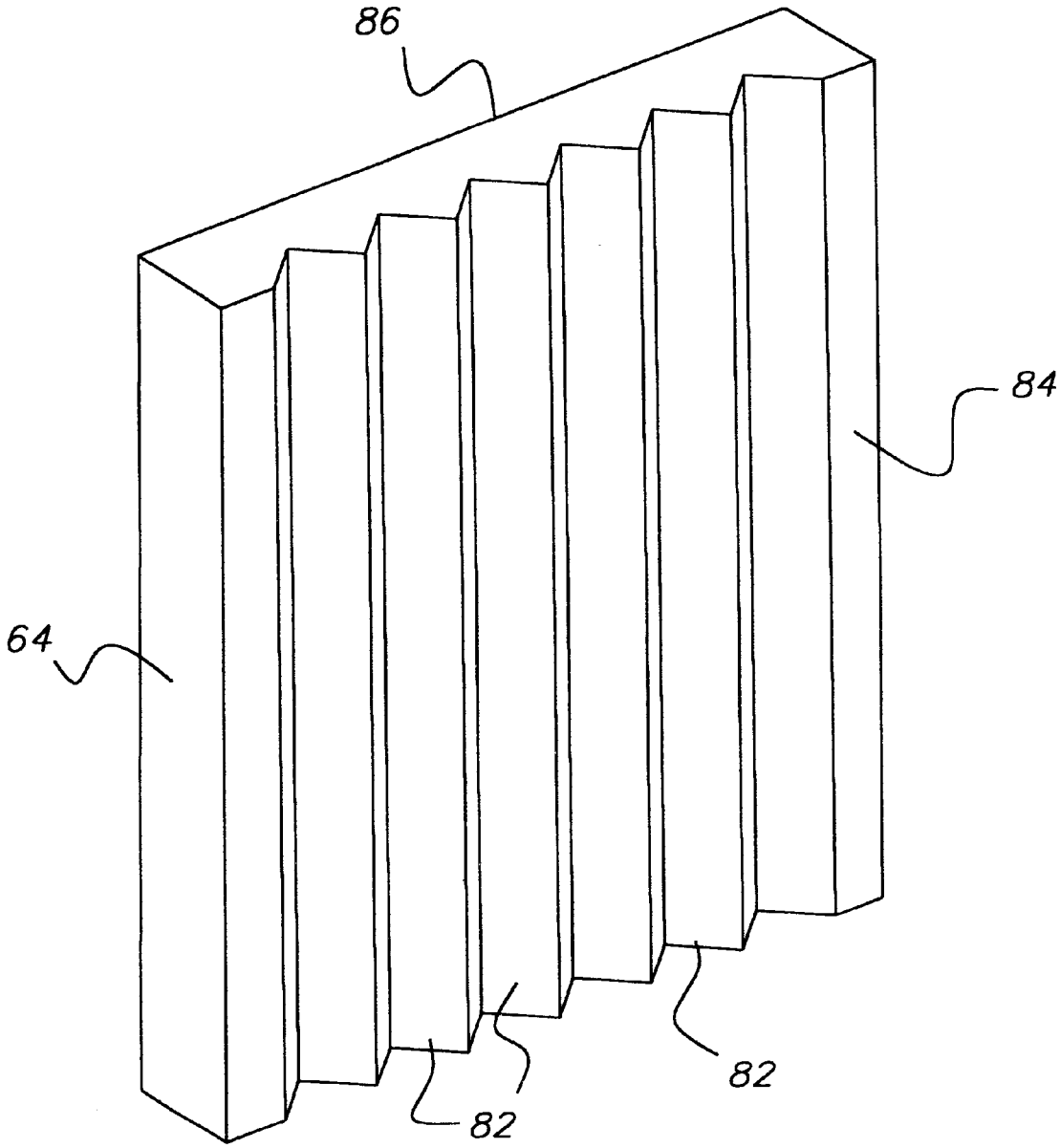
FIG. 9 is a perspective view of an alternative embodiment of a feature made in accordance with the present invention.
Figure 10A:
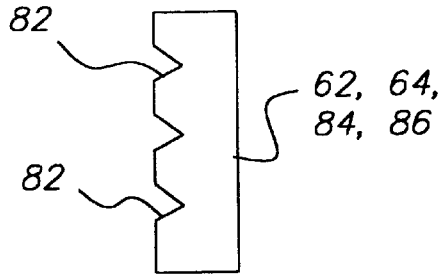
FIGS. 10A–10E are top views of alternative embodiments of a feature made in accordance with the present invention.
Figure 10B:
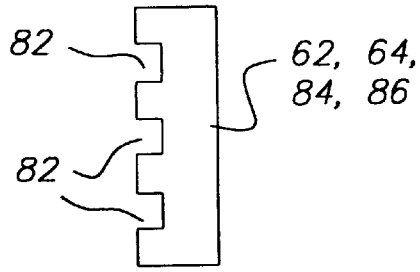
Figure 10C:
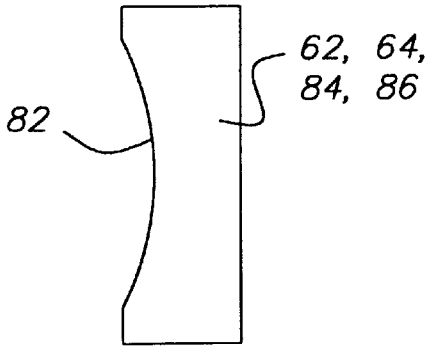
Figure 10D:
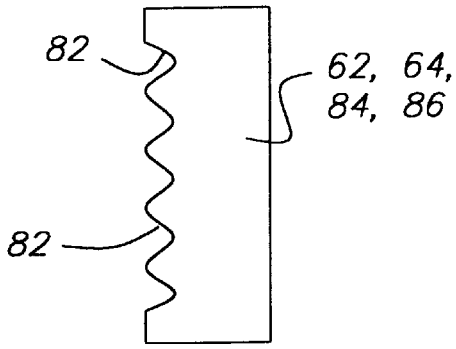
Figure 10E:
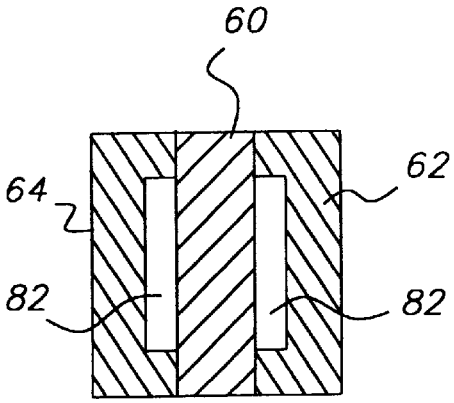

Referring to FIGS. 9 and 10A–10E, various shapes of channel 82 are shown. These shapes include channels 82 having a generally triangular cross section, as shown in FIGS. 9 and 10A; a generally square cross section, as shown in FIG. 10B; a generally elliptical or curved cross section, as shown in FIGS. 10C (illustrating a single channel) and 10D (illustrating a plurality of channels); and a generally rectangular cross section, as shown in FIG. 10E. Surprisingly, test results have shown that channels 82 having an elliptical or curved cross section, as shown in FIG. 10D, work unusually well for improving and assisting with ink fluid flow from screen 60 to fluid return channels 76. Again, it is to be understood that the channel shapes disclosed in FIGS. 9 and 10A–10E may be positioned on any surface of screen support 70, top cover 62, and bottom cover 64 that contacts screen 60 and fluid return channel 76. Also, channels 82 may extend over the entire length of screen support 70, top cover 62, and bottom cover 64, or any portion thereof Additionally, it is contemplated that channels 82 may be positioned on right and left side covers 66 and 68, respectively, also resulting in improved ink fluid flow.

Again referring to FIGS. 7 and 8, in a preferred embodiment, screen support 70 includes two legs 88 and 90 joined at an elbow 92 in a substantially "L" shape. Leg 90 extends in a direction that is substantially towards the direction of non-printed ink drop flow such that non-printed ink drops contact leg 90, either directly or directly through screen 60. The substantially "L" shape decreases the distance non-printed ink drops must travel before reaching their destination, thereby reducing the overall size of the catcher assembly and printhead assembly. As screen 60 is positioned substantially about screen support 70, in a preferred embodiment, screen 60 also has a substantially "L" shape.

Figure 11:
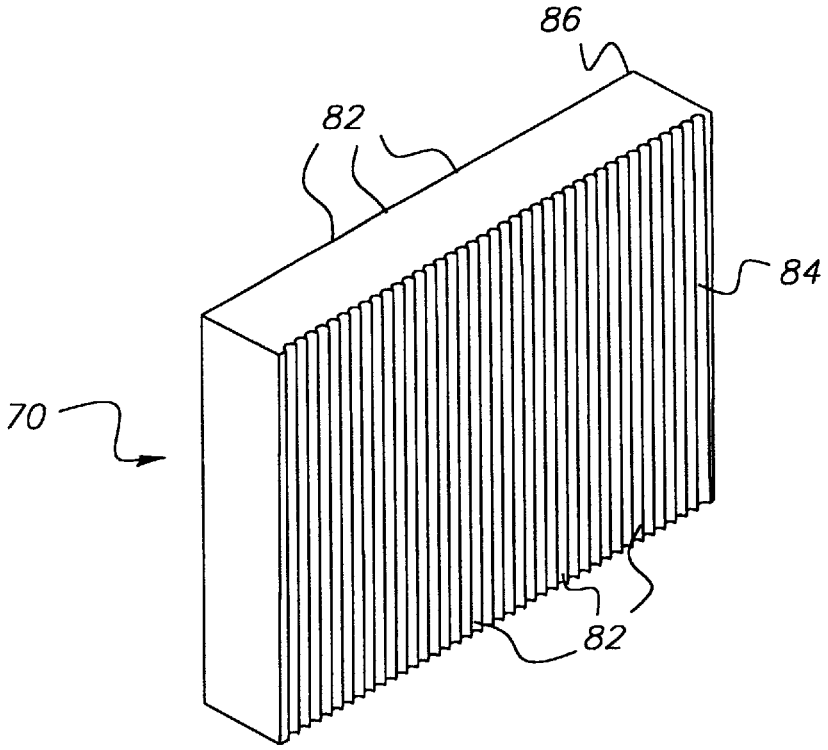
FIG. 11 is a perspective view of an alternative embodiment of a feature made in accordance with the present invention.
Figure 12:
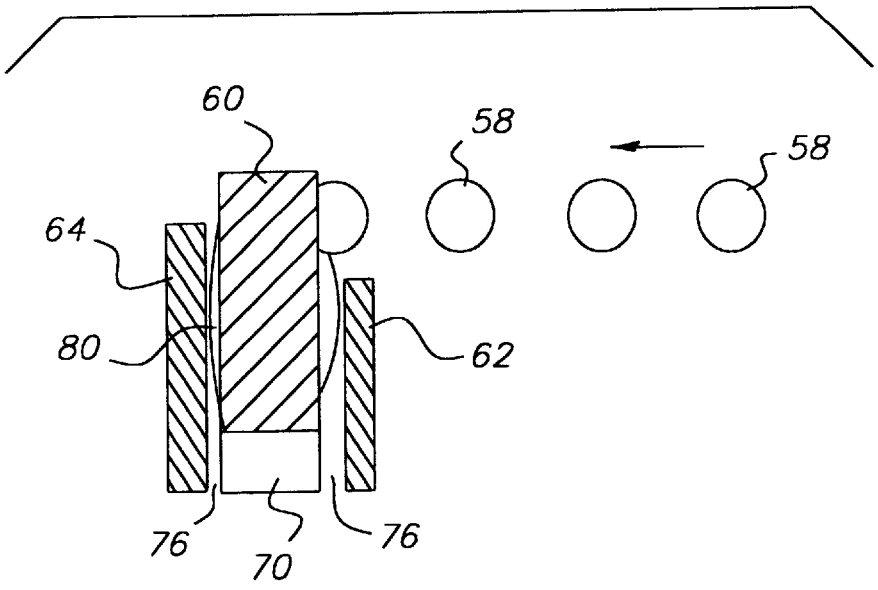
FIG. 12 is a partial side cross sectional view of an alternative embodiment of a feature made in accordance with the present invention.

Referring to FIGS. 11 and 12, an alternative embodiment for screen support 70 is shown. In this embodiment, screen support 70 is substantially straight having at least one channel 82 extending longitudinally over generally the entire length of screen support 70. Screen 60 is positioned substantially about screen support 70 with at least a portion of screen 60 and screen support 70 extending beyond top cover 62 and bottom cover 64 of housing 30. Screen 60 is operable to receive non-printed ink drops 58 directly, thereby creating an ink fluid layer as described above, resulting in at least the same advantages also described above.

The invention has been described in detail with particular reference to certain preferred embodiments thereof, but it will be understood that variations and modifications can be effected within the spirit and scope of the invention.

PARTS LIST

Printhead 20
Ink Supply Reservoir 22
Ink droplets 24
Recording Media 26
Catcher assembly 28
Housing 30
Fluid return channel 32
Ink recovery system 34
Ink delivery channel 36
Nozzle bore 38
Substrate 40
Ink 42
Stream 44
Drops 46
Heater 48
Insulating layer 50
Heater section 52*a*
Heater section 52*b*
Power connection 54*a*
Power connection 54*b*
Ground connection 56*a*
Ground connection 56*b*
Non-deselected ink drop 58
Screen 60
Top cover 62
Bottom cover 64
Right side cover 66
Left side cover 68
Screen support 70
Vacuum manifold 72
Screen end 74
Fluid return channel 76
Ink droplet transformation 78
Fluid 80
Channel 82
Front surface 84
Back surface 86
Screen support leg 88
Screen support leg 90
Screen support elbow 92

What is claimed is:

1. An ink drop catcher assembly comprising:

a housing defining a fluid return channel having a surface, at least a portion of said surface having a groove substantially parallel to said fluid return channel; and a screen extending from said housing operable to collect non-printed ink drops, said screen being in fluid communication with said groove such that ink flows from said screen to said fluid return channel.

2. The ink drop catcher assembly as defined in claim 1, wherein said housing includes a screen support and said screen is at least partially positioned about said screen support.

3. The ink drop catcher assembly as defined in claim 2, wherein a portion of said screen support is angled toward a direction of ink drop flow.

4. The ink drop catcher assembly as defined in claim 2, wherein said screen support includes a surface, at least a portion of said surface having a groove substantially parallel to said fluid return channel, said groove of said screen support surface being in fluid communication with said screen.

5. The ink drop catcher assembly as defined in claim 4, wherein said groove of said screen support surface has a cross section and at least a portion of said cross section is elliptical.

6. The ink drop catcher assembly as defined in claim 1, wherein a portion of said screen is angled toward a direction of ink drop flow.

7. The ink drop catcher assembly as defined in claim 1, wherein said screen is made from a woven wire mesh material.

8. An ink drop catcher assembly comprising:

a housing defining a fluid return channel having a surface, at least a portion of said surface having a groove substantially parallel to said fluid return channel; and a screen extending from said housing operable to collect non-printed ink drops, said screen being in fluid communication with said groove such that ink flows from said screen to said fluid return channel, wherein said groove of said fluid return channel surface has a cross section and at least a portion of said cross section is elliptical.

9. A printer comprising:

a printhead having a printed ink drop path and a non-printed ink drop path, said printhead being operable to deliver ink drops along said printed ink drop path and said non-printed ink drop path; and a catcher assembly positioned adjacent said non-printed ink drop path; said catcher assembly having a screen extending into said non-printed ink drop path such that ink drops travelling along said non-printed ink drop path first strike said screen, said catcher assembly including a housing defining a fluid return channel having a surface, at least a portion of said housing surface having a groove substantially parallel to said fluid return channel, said groove being in fluid communication with said screen.

10. The printer as defined in claim 9, wherein said housing includes a screen support and said is at least partially positioned about said screen support such that said screen is positioned within a close tolerance to said printed ink drop path.

11. The printer as defined in claim 10, wherein a portion of said screen support is angled toward at least one of said printed ink drop path and said non-painted ink drop path.

12. The printer as defined in claim 10, wherein said screen support includes a surface, at least a portion of said surface having a groove substantially parallel to said fluid return channel, said groove of said screen support surface being in fluid communication with said screen.

13. The printer as defined in claim 12, wherein said groove of said screen support surface has a cross section and at least a portion of said cross section is elliptical.

14. The printer as defined in claim 9, wherein a portion of said screen is angled toward at least one of said printed ink drop path and said non-printed ink drop path.

15. The printer as defined in claim 9, wherein said screen is made from a woven wire mesh material.

16. A printer comprising:

printhead having a printed ink drop path and a non-printed ink drop path, said printhead being operable to deliver ink drops along said printed ink drop path and said non-printed ink drop path; and a catcher assembly positioned adjacent said non-printed ink drop path; said catcher assembly having a screen extending into said non-printed ink drop path such that ink drops travelling along said non-printed ink drop path first strike said screen, said catcher assembly including a housing defining a fluid return channel having a surface, at least a portion of said surface having a groove substantially parallel to said fluid return channel, said groove being in fluid communication with said screen, wherein said groove of said fluid return channel surface has a cross section and at least a portion of said cross section is elliptical.

17. A method of manufacturing an ink drop catcher assembly comprising:

providing a housing defining a fluid return channel having a surface;

grooving at least a portion of the surface, the grooved portion being substantially parallel to the fluid return channel;

providing a screen extending from the housing operable to collect non-printed ink drops; and positioning the screen in fluid communication with the groove such that ink flows from the screen to the fluid return channel.

18. The method as defined in claim 17, further comprising:

providing the housing with a screen support; and at least partially positioning the screen about the screen support.

19. The method as defined in claim 18, wherein the screen support includes a surface, the method comprising:

grooving at least a portion of the surface of the screen support, the grooved portion being substantially parallel to the fluid return channel; and positioning the grooved portion in fluid communication with the screen.

20. An ink drop catcher assembly comprising:

a housing defining a fluid return channel having a surface, at least a portion of said surface having a groove substantially parallel to said fluid return channel, said housing including a screen support, a portion of said screen support being angled toward a direction of ink drop flow; and a screen extending from said housing shaped to collect non-printed ink drops, said screen being in fluid communication with said groove, wherein and said screen is at least partially positioned about said screen support.

21. The ink drop catcher assembly as defined in claim 20, wherein said screen support includes a surface, at least a portion of said screen support surface having a groove substantially parallel to said fluid return channel, said groove of said screen support surface being in fluid communication with said screen.

22. The ink drop catcher assembly as defined in claim 21, wherein said groove of said screen support surface has a cross section and at least a portion of said cross section is elliptical.

23. The ink drop catcher assembly as defined claim 20, wherein a portion of said screen is angled toward a direction of ink drop flow.

24. An ink drop catcher assembly comprising:

a housing defining a fluid return channel having a surface, at least a portion of said surface having a groove substantially parallel to said fluid return channel, said housing including a screen support, a portion of said screen support being angled toward a direction of ink drop flow; and a screen extending from said housing shaped to collect non-printed ink drops, said screen being in fluid communication with said groove, wherein and said screen is at least partially positioned about said screen support, wherein said groove of said fluid return channel surface has a cross section and at least a portion of said cross section is elliptical.

25. An ink drop catcher assembly comprising:

a housing defining a fluid return channel having a surface, at least a portion of said surface having a groove substantially parallel to said fluid return channel; and a screen extending from said housing shaped to collect non-printed ink drops, said screen being in fluid communication with said groove, wherein a portion of said screen is angled toward a direction of ink drop flow.

26. The ink drop catcher assembly as defined in claim 25, wherein said housing includes a screen support and said screen is at least partially positioned about said screen support.

27. The ink drop catcher assembly as defined in claim 26, wherein a portion of said screen support is angled toward a direction of ink drop flow.

28. The ink drop catcher assembly as defined in claim 26, wherein said screen support includes a surface, at least a portion of said surface having a groove substantially parallel to said fluid return channel, said groove of said screen support surface being in fluid communication with said screen.

29. The ink drop catcher assembly as defined in claim 28, wherein said groove of said screen support surface has a cross section and at least a portion of said cross section is elliptical.

30. An ink drop catcher assembly comprising:

a housing defining a fluid return channel having a surface, at least a portion of said surface having a groove substantially parallel to said fluid return channel; and a screen extending from said housing shaped to collect non-printed ink drops, said screen being in fluid communication with said groove, wherein a portion of said screen is angled toward a direction of ink drop flow, wherein said groove of said fluid return channel surface has a cross section and at least a portion of said cross section is elliptical.

31. A printer comprising:

a printhead having a printed ink drop path and a non-printed ink drop path, said printhead being operable to deliver ink drops along said printed ink drop path and said non-printed ink drop path; and a catcher assembly positioned adjacent said non-printed ink drop path; said catcher assembly having a screen extending into said non-printed ink drop path such that ink drops travelling along said non-printed ink drop path fist strike said screen, wherein said catcher assembly comprises:

a housing defining a fluid return channel having a surface, at least a portion of said surface having a groove substantially parallel to said fluid return channel, said groove being in fluid communication with said screen, said housing including a screen support, wherein a portion of said screen support is angled toward at least one of said printed ink drop path and said non-printed ink drop path.

32. The printer as defined in claim 31, wherein and said screen is at least partially positioned about said screen support.

33. The printer as defined in claim 31, wherein a portion of said screen is angled toward at least one of said printed ink drop path and said non-printed ink drop path.

34. A printer comprising:

a printhead having a printed ink drop path and a non-printed ink drop path, said printhead being operable to deliver ink drops along said printed ink drop path and said non-printed ink drop path; and a catcher assembly positioned adjacent said non-printed ink drop path; said catcher assembly having a screen extending into said non-printed ink drop path such that ink drops travelling along said non-printed ink drop path first strike said screen, said catcher assembly including a housing defining a fluid return channel having a surface, at least a portion of said housing surface having a groove substantially parallel to said fluid return channel, said groove being in fluid communication with said screen, wherein a portion of said screen is angled toward at least one of said printed ink drop path and said non-printed ink drop path.

35. The printer as defined in claim 34, wherein said housing includes a screen support and said screen is at least partially positioned about said screen support.

36. The printer as defined in claim 35, wherein a portion of said screen support is angled toward at least one of said printed ink drop path and said non-printed ink drop path.

* * * * *